US005475479A

United States Patent [19]

Hatakeyama et al.

[11] Patent Number: 5,475,479

[45] Date of Patent: Dec. 12, 1995

[54] DEVELOPER CARTRIDGE HAVING AN AUTOMATIC LID CLOSING MECHANISM

[75] Inventors: Takuya Hatakeyama, Yokohama; Yutaka Ban, Tokyo, both of Japan

[73] Assignee: Canon Kabushiki Kaisha, Tokyo, Japan

[21] Appl. No.: 274,209

[22] Filed: Jul. 12, 1994

Related U.S. Application Data

[63] Continuation of Ser. No. 149,136, Nov. 8, 1993, abandoned, which is a continuation of Ser. No. 965,709, Oct. 23, 1992, abandoned.

[30] Foreign Application Priority Data

Nov. 8, 1991 [JP] Japan ..... 3-319655

[51] Int. Cl.[6] ..... G03G 15/06; G03G 21/00

[52] U.S. Cl. ..... 355/260

[58] Field of Search ..... 355/200, 210, 355/260

[56] References Cited

U.S. PATENT DOCUMENTS

| | | | |
|---|---|---|---|
| 4,142,655 | 3/1979 | Fantuzzo | 222/318 |
| 4,491,161 | 1/1985 | Tamura et al. | 355/260 X |
| 4,589,579 | 5/1986 | Morita | 222/561 |
| 4,614,286 | 9/1986 | Yamaguchi et al. | 222/505 |
| 4,650,070 | 3/1987 | Oka et al. | 206/216 |
| 4,799,608 | 1/1989 | Oka . | |
| 4,834,246 | 5/1989 | Inoue et al. | 206/631 |
| 4,895,104 | 1/1990 | Yoshino et al. | 118/653 |
| 4,954,844 | 9/1990 | Morita et al. | 355/260 |
| 4,961,450 | 10/1990 | Furuta | 141/364 |
| 4,981,218 | 1/1991 | Ban et al. | 206/633 |
| 5,018,560 | 5/1991 | Tsukamoto | 355/260 X |
| 5,040,024 | 8/1991 | Fukuda et al. | 355/260 |
| 5,040,025 | 8/1991 | Fuckuchi | 355/260 |
| 5,089,854 | 2/1992 | Kaiedo et al. | 355/260 |
| 5,091,750 | 2/1992 | Yoshida et al. | 355/260 |
| 5,153,650 | 10/1992 | Maeshima | 355/260 |
| 5,172,165 | 12/1992 | Hatakeyama et al. | 355/215 |
| 5,175,588 | 12/1992 | Katagata | 355/260 |
| 5,177,540 | 1/1993 | Honda et al. | 355/260 |
| 5,207,353 | 5/1993 | Corby | 222/1 |

FOREIGN PATENT DOCUMENTS

| | | |
|---|---|---|
| 0102002 | 3/1984 | European Pat. Off. . |
| 57-38673 | 8/1982 | Japan . |
| 58-224364 | 12/1983 | Japan . |
| 59-57262 | 4/1984 | Japan . |
| 60-198567 | 10/1985 | Japan . |
| 60-154967 | 10/1985 | Japan . |
| 61-153054 | 9/1986 | Japan . |
| 61-153054 | 9/1986 | Japan . |
| 63-178272 | 7/1988 | Japan . |
| 63-132962 | 8/1988 | Japan . |
| 63-249870 | 10/1988 | Japan . |
| 63-170851 | 11/1988 | Japan . |
| 1-71762 | 5/1989 | Japan . |
| 1-71761 | 5/1989 | Japan . |
| 1-223483 | 9/1989 | Japan . |
| 3102371 | 4/1991 | Japan . |

*Primary Examiner*—Fred L. Braun

*Attorney, Agent, or Firm*—Fitzpatrick, Cella, Harper & Scinto

[57] ABSTRACT

A developer cartridge for supplying developer to a developer receiving unit has a lid by which a developer discharge opening is opened/closed. If the cartridge is unloaded from the developer receiving unit when the lid is not at a predetermined position where the developer discharge opening is completely closed, the lid is engaged by an engagement portion of the developer receiving unit and is moved to the predetermined position.

6 Claims, 14 Drawing Sheets

DEVELOPER CARTRIDGE HAVING AN AUTOMATIC LID CLOSING MECHANISM

This application is a continuation of application Ser. No. 08/149,136, filed Nov. 8, 1993, now abandoned which is a continuation of Ser. No. 07/965,709, filed Oct. 23 1992, now abandoned.

BACKGROUND OF THE INVENTION

1. Field of the Invention

The present invention relates to a developer cartridge for supplying a developer to a developer receiving unit of an image formation apparatus, such as an electrophotographic apparatus, which forms electrostatic latent images and develops them with a dry developer.

2. Description of the Related Art

A developer cartridge which is loaded into a developer receiving unit of an image formation apparatus in order to supply developer thereto, and which is unloaded from the developer receiving unit after the developer is supplied thereto, is well known.

Some developer cartridges are provided with sliding lids which open/close a developer discharge opening disposed on the main body of the cartridge. The sliding lid is opened to supply the developer to the developer receiving unit. Thereafter, the discharge opening is closed by the sliding lid, and then the cartridge is unloaded from the developer receiving unit.

If the cartridge is bumped when it is being unloaded from the developer receiving unit, the impact may cause the sliding lid to be displaced from the position where the discharge opening is closed, and the cartridge may be unloaded from the developer receiving unit while it is not completely closed.

In such a case, a small amount of developer remaining in the main body of the cartridge may spill out, soiling the clothes of the operator, the image formation apparatus or the like.

Such an accident is more likely to occur in a cartridge which the direction the sliding lid moves to open the discharge opening of the developer, is the same as that in which it is moved to remove the cartridge from the developer receiving unit.

This may also occur when the cartridge is erroneously unloaded from the developer receiving unit when the sliding lid is not moved to the position where the developer discharge opening is completely closed.

SUMMARY OF THE INVENTION

An object of the present invention is to prevent the cartridge from being unloaded from the developer receiving unit when the lid member does not completely close the developer receiving unit of the cartridge.

Another object of the present invention is to provide an improved developer cartridge.

When the developer cartridge of the present invention is loaded such that the developer in the main body of the cartridge is to be supplied to the developer receiving unit, the developer cartridge is guided and moved in a first direction on the developer receiving unit; when it is unloaded from the developer receiving unit, it is guided and moved in a second direction opposite to the first direction.

When the developer discharge opening is opened, the lid member of the cartridge is moved in a second direction relative to the main body of the cartridge; when the developer discharge opening is closed, the lid member is moved in a first direction relative to the main body of the cartridge.

The lid member has an engagement portion which is engagable with an engagement portion of the developer receiving unit when the cartridge is moved in a second direction from the developer supply position when the lid member is not at a predetermined position where the discharge opening is completely closed.

When the engagement portion of the lid member is engaged with the engagement portion of the developer receiving unit, the lid member is moved in a first direction relative to the main body of the cartridge since the cartridge is moved in a second direction. Thus, the lid member is moved to the predetermined position where the discharge opening is completely closed.

Therefore, the developer can be prevented from spilling since the cartridge can only be unloaded from the developer receiving unit when the developer discharge opening is securely closed by the lid member.

Objectives and advantages in addition to those discussed above shall be apparent to those skilled in the art from the description of the preferred embodiment of the invention which follows. In the description, reference is made to the accompanying drawings, which form a part hereof, and which illustrate an example of the invention. Such example, however, is not exhaustive of the embodiments of the invention, and therefore reference is made to the appended claims for determining the scope of the invention.

Figure 12:
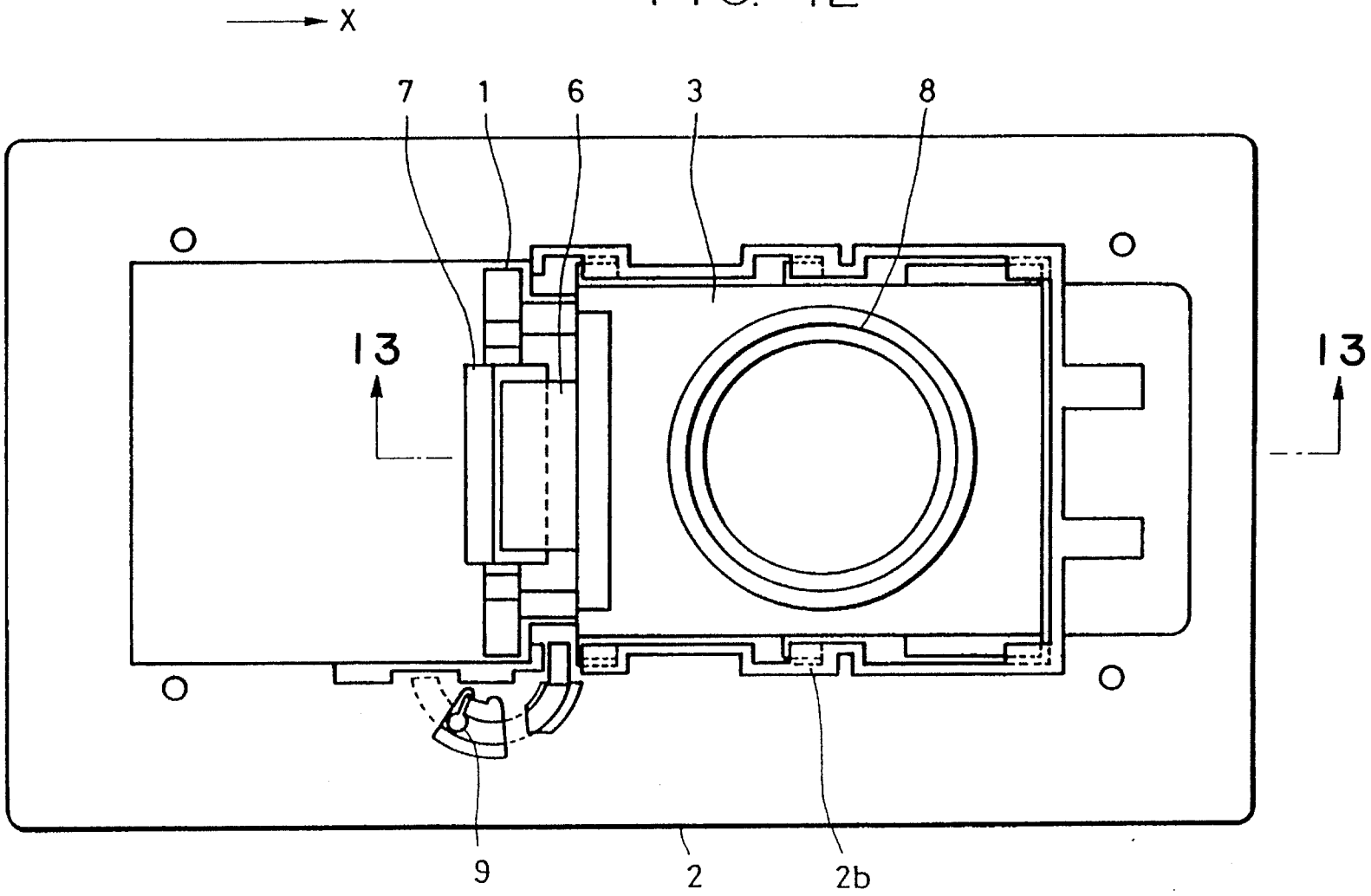
FIG. 12 is a plan view illustrating a state in which the supply of the developer from the developer cartridge of FIG.
Figure 13:
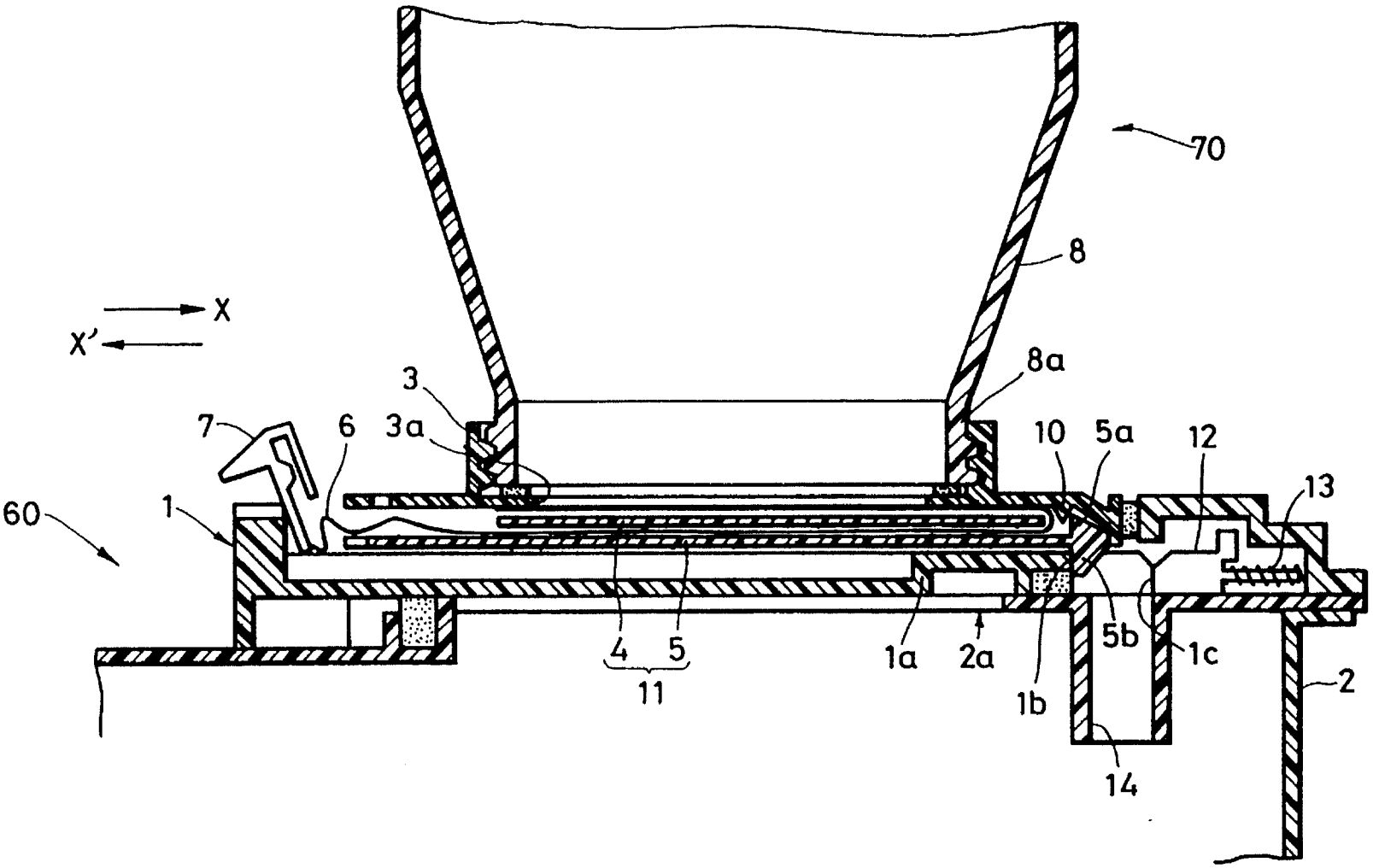
Figure 14:
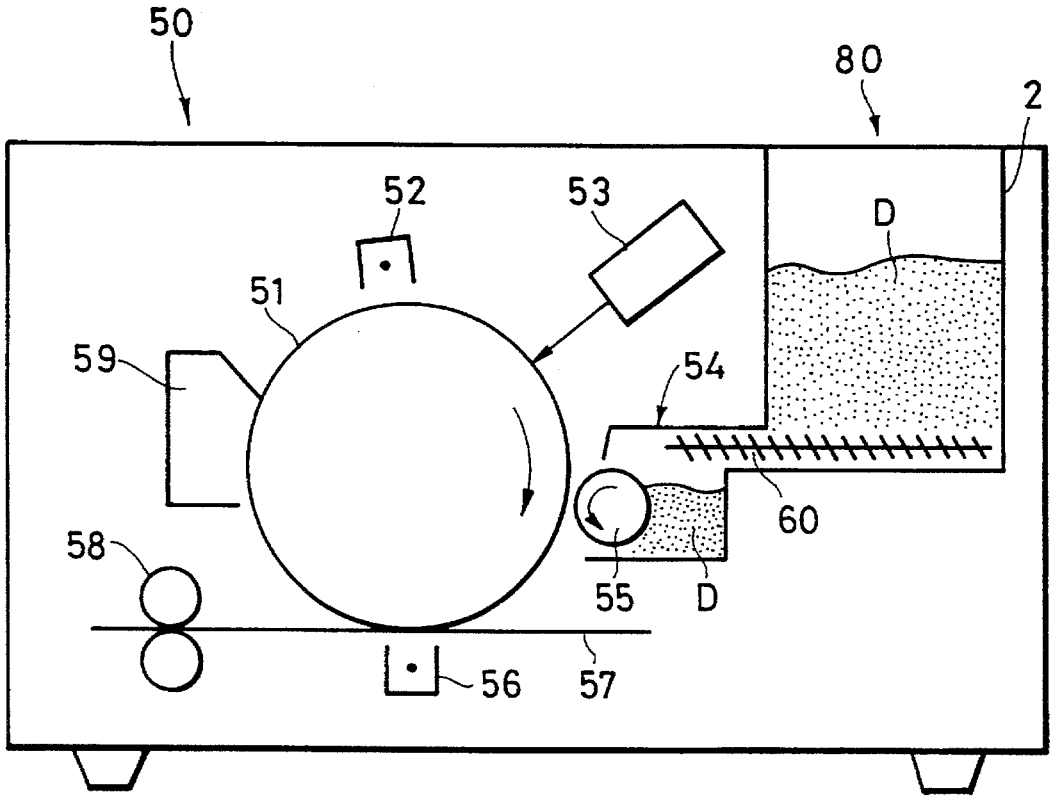

1 to the developer receiving unit has been completed;

FIG. 13 is an enlarged view illustrating a partial cross section taken along a line 13—13 of FIG. 12; and FIG. 14 illustrates an electrophotographic apparatus to which the present invention can be applied.

DESCRIPTION OF THE PREFERRED EMBODIMENT

In FIG. 14, an electrophotographic image formation apparatus 50 has an electrophotographic photosensitive body 51 which rotates in the direction indicated by an arrow. The photosensitive body 51 is first charged by a charger 52 and then irradiated with recording image light by an exposer 53, thereby forming an electrostatic latent image on the photosensitive body 51.

The electrostatic latent image is developed by a development unit 54 which has a development roller 55 which rotates in the direction indicated by an arrow. This development roller 55 carries and transports a developer D and applies it to the electrostatic latent image.

The developed image is transferred to transfer paper 57 by a transfer charger 56. The image is fixed to the paper 57 by a fixer 58. After the transfer process, the photosensitive body 51 is cleaned by a cleaner 59.

To replace the developer consumed as a result of development of the image, developer D is supplied to the development unit 54 by a transport apparatus 60, such as a screw conveyor, from a developer receiving container 2 (a hopper) of a developer receiving unit 80. When the amount of the developer D inside the developer receiving container 2 becomes less than a predetermined amount, developer is supplied into the container 2 from the developer cartridge by the operator.

The developer cartridge and the developer receiving unit will now be explained in detail.

Figure 1:
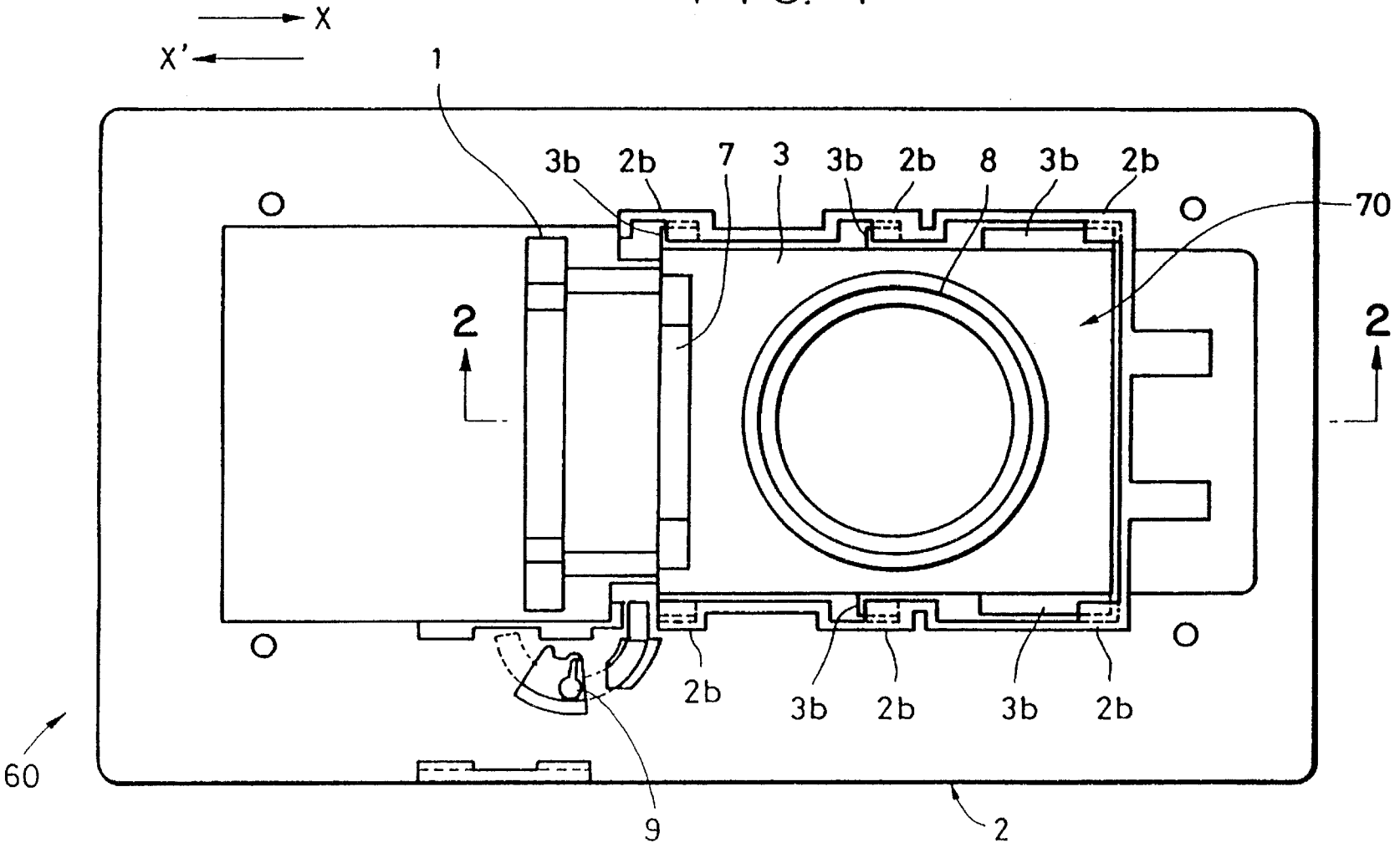
FIG. 1 is a plan view illustrating an essential portion of a developer according to an embodiment of the present invention and a developer receiving unit to which a developer is supplied.
Figure 2:
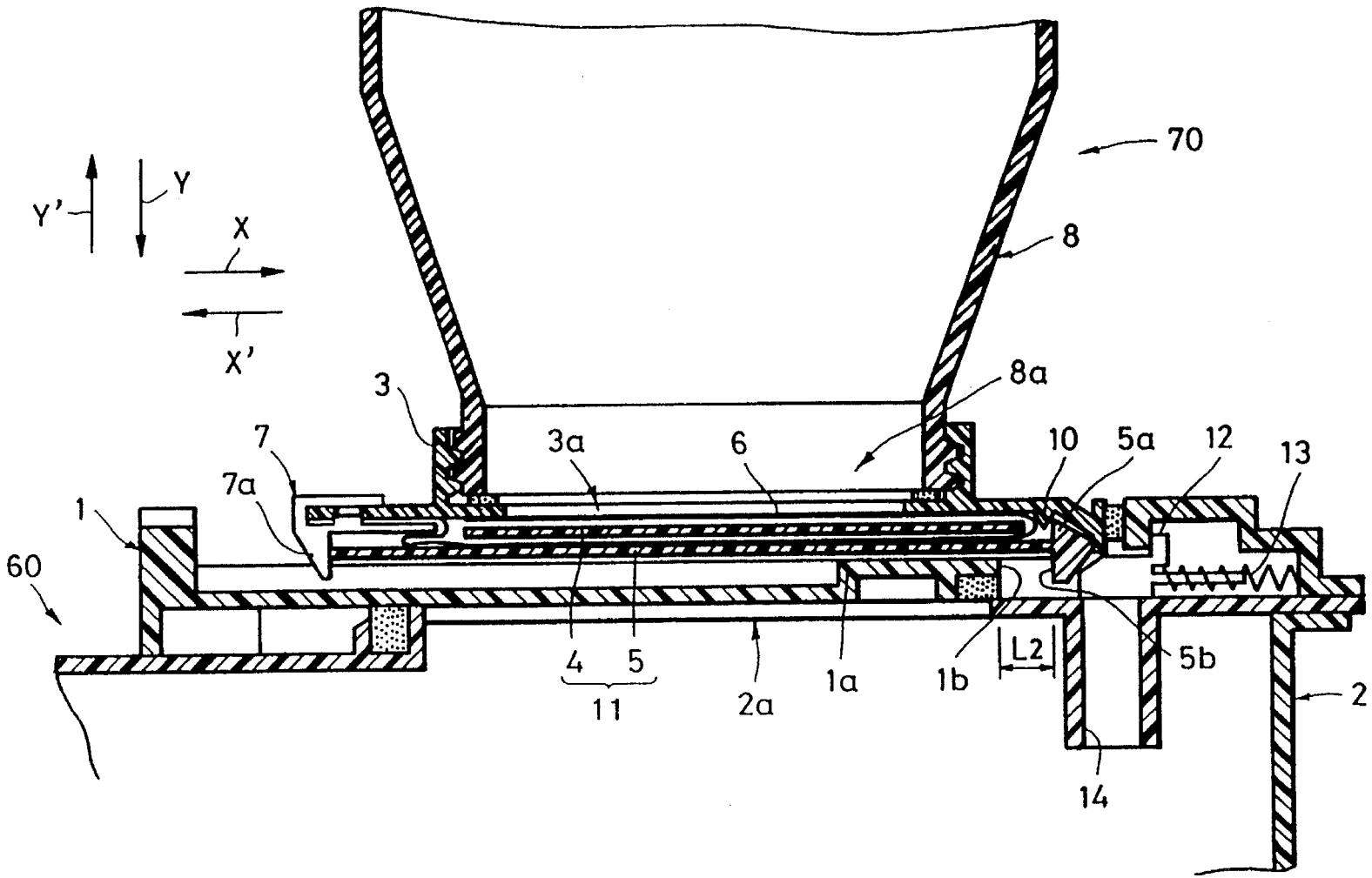
FIG. 2 is an enlarged view illustrating a partial cross section taken along a line 2—2 of FIG. 1.

As described above, a development apparatus is used in an image formation apparatus and the developer receiving container 2 is mounted on the development apparatus. As shown in FIGS. 1 and 2, an opening 2*a* through which a developer is received, a subopening 14, and guide portions 2*b* for defining the passage in which the cartridge is guided, are disposed in the developer receiving container 2. The opening 2*a* is covered with a sliding type shutter 1. The sliding type shutter 1 is moved between a position where the opening 2*a* is covered and a position where the opening 2*a* is opened in the same direction as that in which the cartridge is guided and moved. The subopening 14 is covered in such a manner as to be openable by a subshutter 12. The subshutter 12 is biased in a position where the subopening 14 is covered by a spring member 13.

Figure 4:
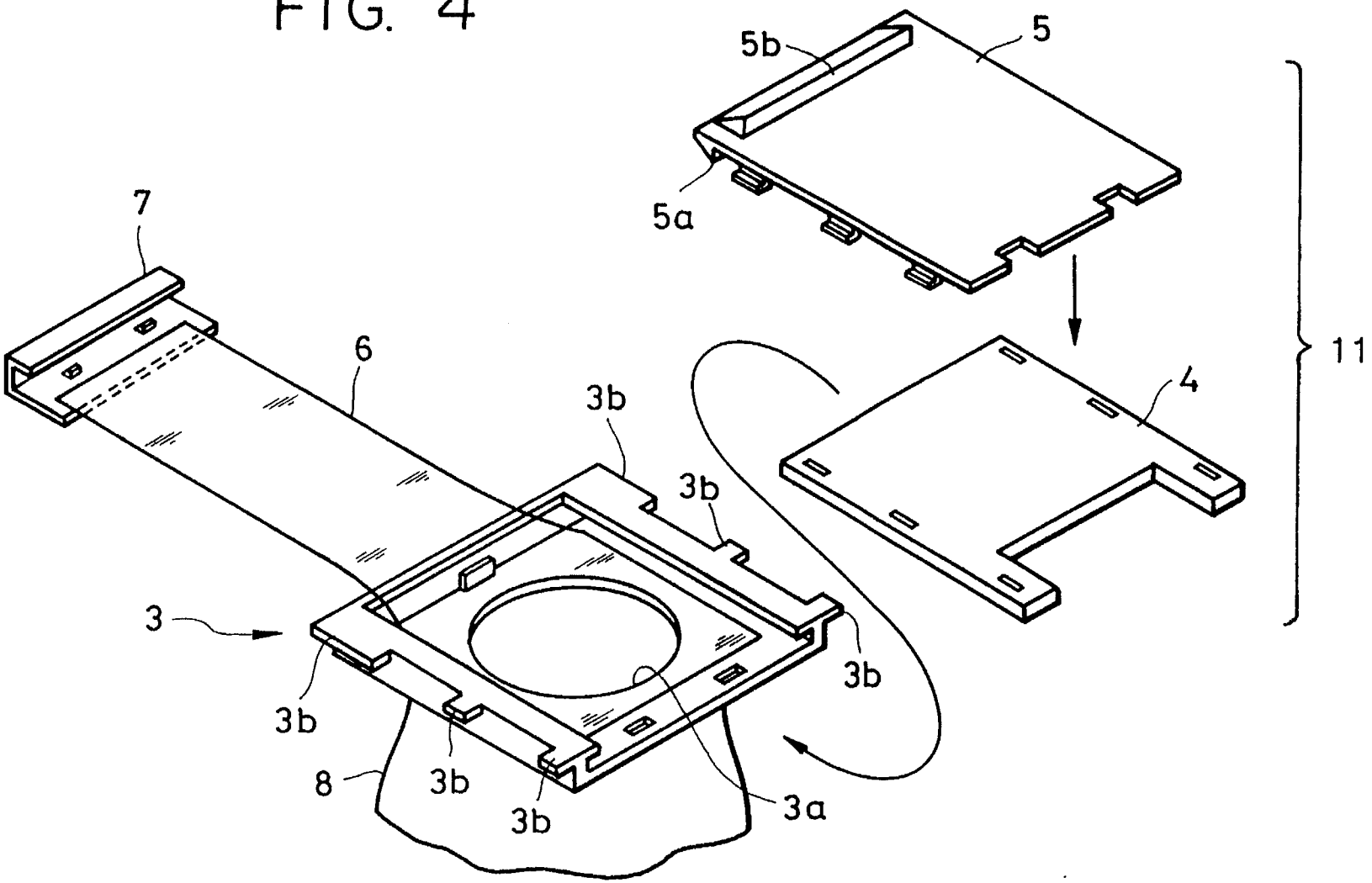
FIG. 4 is an exploded perspective view illustrating the essential portion of the developer cartridge of FIG. 1.
Figure 5:
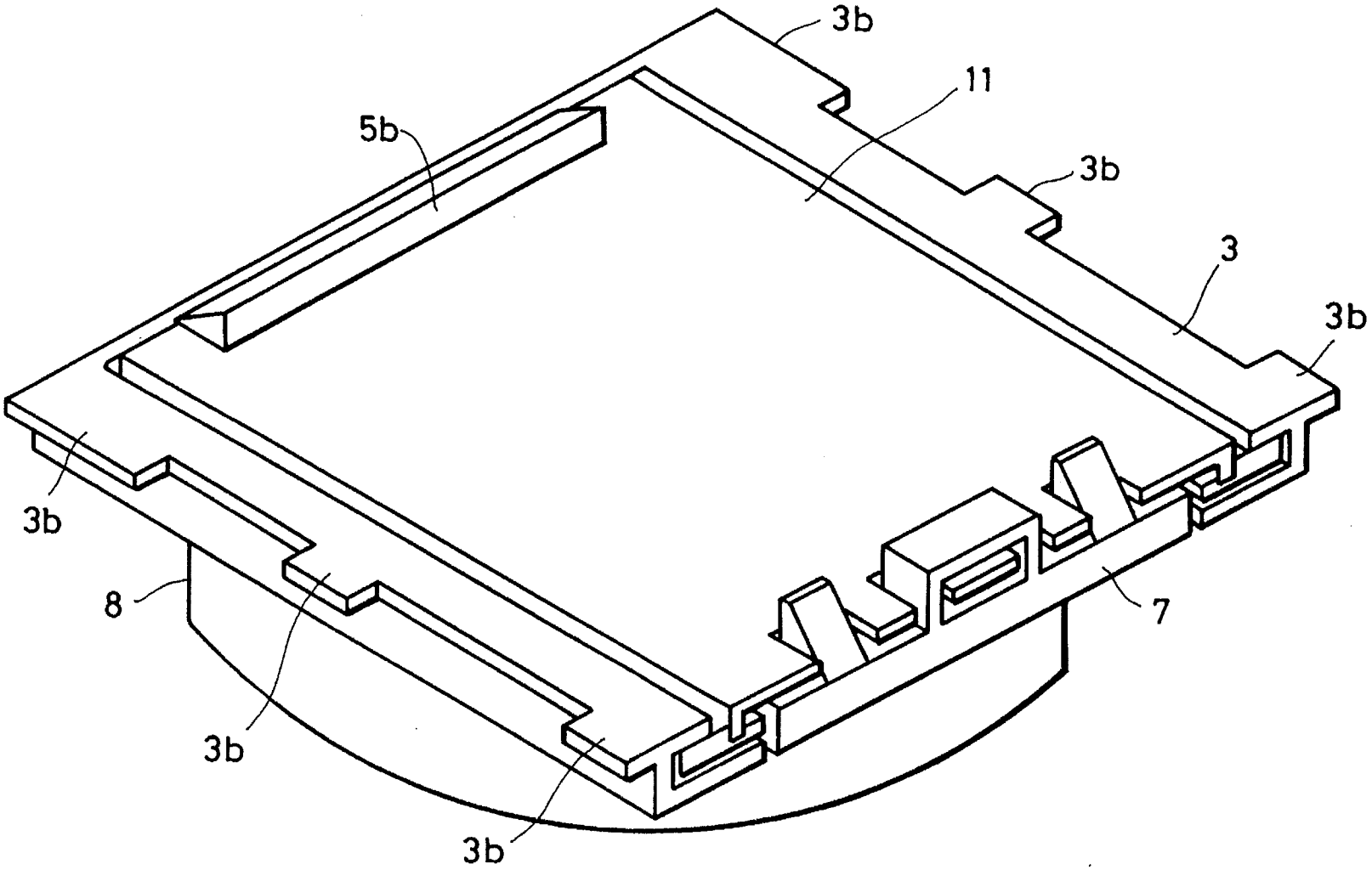
FIG. 5 is a perspective view illustrating a state in which the knob of the developer cartridge of FIG. 1 is engaged with a sliding type opening/closing lid.

The developer is supplied to the developer receiving container 2 from a developer cartridge 70. As shown in FIGS. 2, 4 and 5, the developer supply apparatus has a developer supply container 8 for storing a developer to be supplied. An outlet 8*a* for discharging a developer is provided on the bottom portion of the developer supply container 8, and a spring portion is formed on the outer surface of the outlet 8*a* (for the sake of simplicity, the developer is not shown).

A frame 3 made from a synthetic resin is screwed into the spring portion of the outlet 8*a*. Six fin-shaped projections 3*b* provided on the frame 3 are removably engagable with six guide portions 2*b* of the developer receiving container 2 (see, e.g., FIG. 1). A hole 3*a* through which the developer is passed is provided on the frame 3, the hole 3*a* being arranged coaxially with the outlet 8*a*. An engagement section 10 or projection which projects downwardly is provided on the frame 3.

Figure 3:
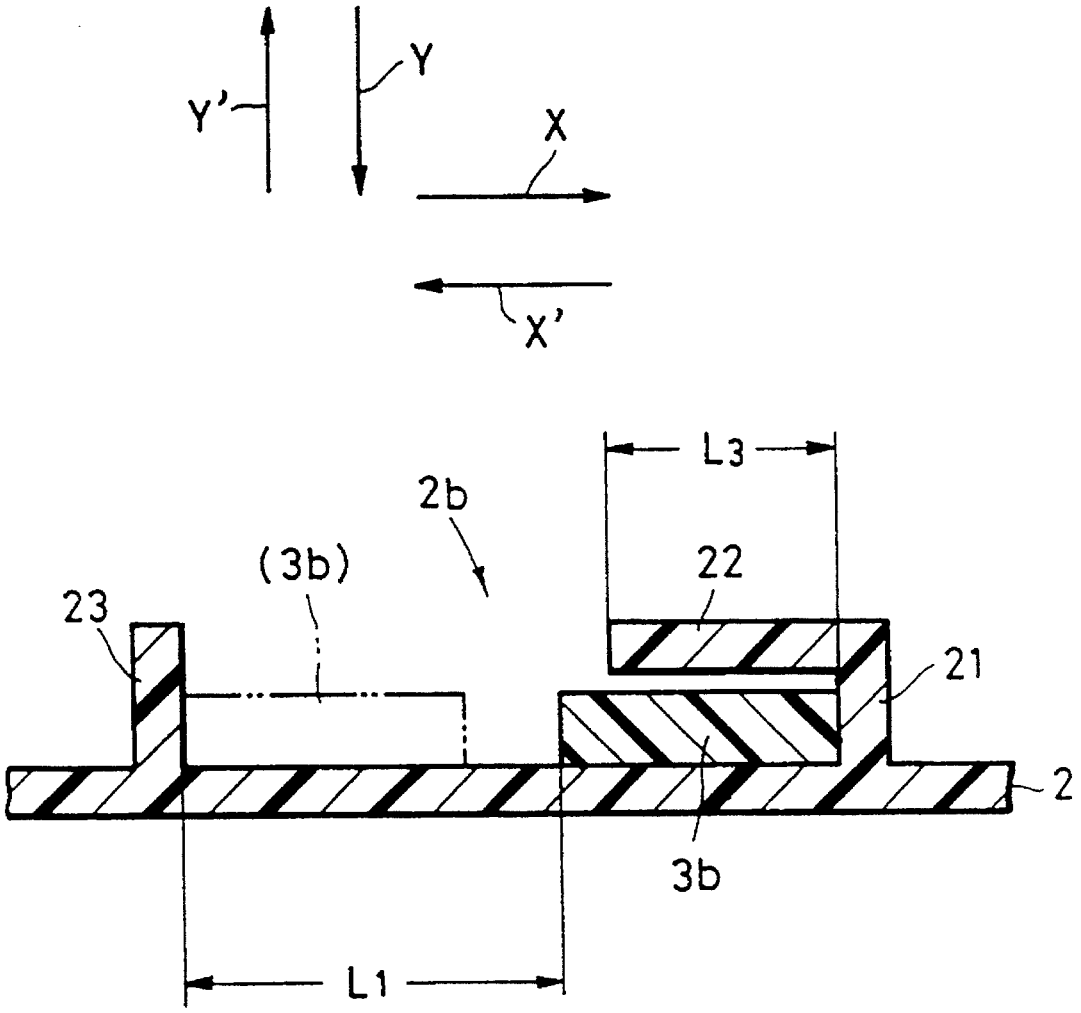
FIG. 3 illustrates a guide section.

Referring to FIG. 3, a guide portion 2*b* will be explained.

Stopper wall portions 21 and 23 which define both ends of the horizontal movement of one of the projections 3*b* of the frame 3 of the cartridge are provided in an upright manner on the developer receiving container 2. A roof portion 22 for blocking the above projection portion 3*b* from moving upwardly projects in a horizontal direction from the stopper wall portion 21.

The operator holds the cartridge by hand and moves it so as to move the projection portion 3*b* fixed to the cartridge as described below.

First, the cartridge is moved downwardly in a vertical direction as indicated by arrow Y. The projection portion 3*b* thereof is placed on the top surface of the developer receiving container 2 between an open end of the roof portion 22 and the wall portion 23. Next, the cartridge is moved horizontally to the right as indicated by arrow X, causing the projection portion 3*b* to be brought into abutment with the wall portion 21. This state indicates that the cartridge is at a position where the developer is to be supplied on the container 2. In this state, the roof portion 22 prevents the cartridge from being unloaded upwardly from the container 2.

When all of the developer has been supplied, the projection portion 3*b* is moved in the direction indicated by arrow X' opposite to the X direction, causing the projection portion 3*b* to be placed outside of the range in which the upward movement of the projection portion 3*b* is regulated by the roof portion 22.

Next, the cartridge is moved in the direction indicated by arrow Y' opposite to the direction indicated by arrow Y, causing the projection portion 3*b* to be removed out of the guide portion 2*b* through the section between the open end of the roof portion 22 and the wall portion 23. That is, the cartridge is unloaded from the container 2.

The distance range in which the cartridge can be moved horizontally (X and X' directions) in a state in which the projection portion 3*b* thereof is engaged with the guide portion 2*b* is between a first position (shown as a solid line) and a second position (shown as alternately long and short dashed lines), that is, a distance $L_1$.

The distance range in the horizontal direction of the area in which the projection portion 3*b* is prevented from moving upward by the roof portion 22 is $L_3$. The cartridge is movable horizontally in the distance range $L_3$, but is prevented from being unloaded from the container 2. Distance $L_1$ is greater than distance $L_3$.

When the above-mentioned sliding type shutter 1 is moved in the direction indicated by arrow X', the developer inlet 2*a* of the container 2 is opened. When the sliding shutter 1 is moved in the direction indicated by arrow X, the opening 2*a* is closed.

A sliding type opening/closing lid 11 is mounted on the frame 3 in such a manner as to be movable between a position where an outlet 8*a* of the developer supply container 8 is closed and a position where the outlet 8*a* is opened. In a state in which the cartridge is at a position where the developer is supplied, the direction in which the sliding type opening/closing lid 11 is moved is the same as that in which the sliding type shutter 1 is moved. The sliding type opening/closing lid 11 comprises a plate-like member 4 made from a synthetic resin and a plate-like member 5 made from a synthetic resin which is bonded integrally with the member 4 with a slight space inbetween. The plate-like member 5 is placed below the plate-like member 4. A projection portion 5*a* is provided on the plate-like member 5, which projection is engaged with the engagement section or projection 10 When the outlet 8*a* is completely closed by the lid 11 to thereby lock the lid in a predetermined or closed position (see, e.g., FIG. 2).

Since the engagement section 10 provided on the frame 3 is engaged with the projection portion 5*a* of the lid 11, the occurrence of the lid 11 being moved inadvertently to open the outlet 8*a* is prevented before the cartridge is loaded into the container 2 and after it is unloaded therefrom.

When the operator pulls the lid 11 in the direction indicated by arrow X' the projection portion 5*a* leftwardly climbs over the slope of the projection 10, and the engagement of the two projections is released. As a result, the lid 11 is movable in the direction in which the outlet 8*a* is opened. In contrast, when the outlet 8*a* is closed, the lid 11 is pressed in the direction indicated by arrow X, causing the projection 5*a* to rightwardly climb over the slope of the projection 10, and the two projections are engaged with each other. Although two slopes are provided on the projection 10 in this figure, they may be provided on the projection 5*a* or on both the projections 10 and 5*a*.

A flexible film member 6 is mounted on the frame 3, as shown in FIGS. 2 and 4. The end portions of the film member 6 are fixed in the periphery of a hole 3*a* of the frame 3 by heat deposition or the like in such a manner that the film member 6 can be peeled off frame 3. The film member 6 comprises a fixation portion which covers the hole 3*a* of the frame 3 and a folding portion which is folded with respect to the fixation portion and extends outwardly through a flat opening between the plate-like member 4 and the plate-like member 5. A grip 7 is fixed to the end of the folding portion such that it is not easily released.

As shown in FIG. 2, the grip 7 is releasably engaged with the frame 3. When the engagement of the grip 7 with the frame 3 is released, if the operator holds the grip 7 by hand and pulls it, the film member 6 is pulled out of the frame 3 from the end to which the grip 7 is fixed while the film member 6 causes the lid 11 to be moved in the direction indicated by arrow X' on the basis of the principles of a running block. The sliding type lid 11 is moved to a position where the outlet 8*a* is completely opened. When the sliding type lid 11 is engaged with the frame 3, the folding portion of the film member 6 between the sliding type lid 11 and the grip 7 is folded and housed inside the frame 3.

The frame 3 of the cartridge positioned where the cartridge is supplied is releasably fixed to the developer receiving container 2 by a movable locking member 9 shown in FIG. 1. The locking member 9 fixes the frame 3 to the developer receiving container 2 and at the same time releases the fixed state of the sliding type shutter 1. Thus, the sliding type shutter 1 becomes movable in the direction indicated by arrow X'. The locking member 9 is rotated manually by the operator.

The distance between the engagement portion (a wall surface 1*b*) provided on the sliding type shutter 1 of the container 2 and the portion to be engaged 5*b* (a projected surface) provided on the lid 11 of the cartridge is $L_2$, as shown in FIG. 2, when the shutter 1 is locked by the locking member 9, that is, when the shutter 1 completely closes the opening 2*a* of the container 2, and when the cartridge 70 is set where the developer is to be supplied. Distance $L_2$ is smaller than distance $L_1$ and greater than distance $L_3$.

Next, the sequence for supplying a developer to the developer receiving container will be explained.

Figure 6:
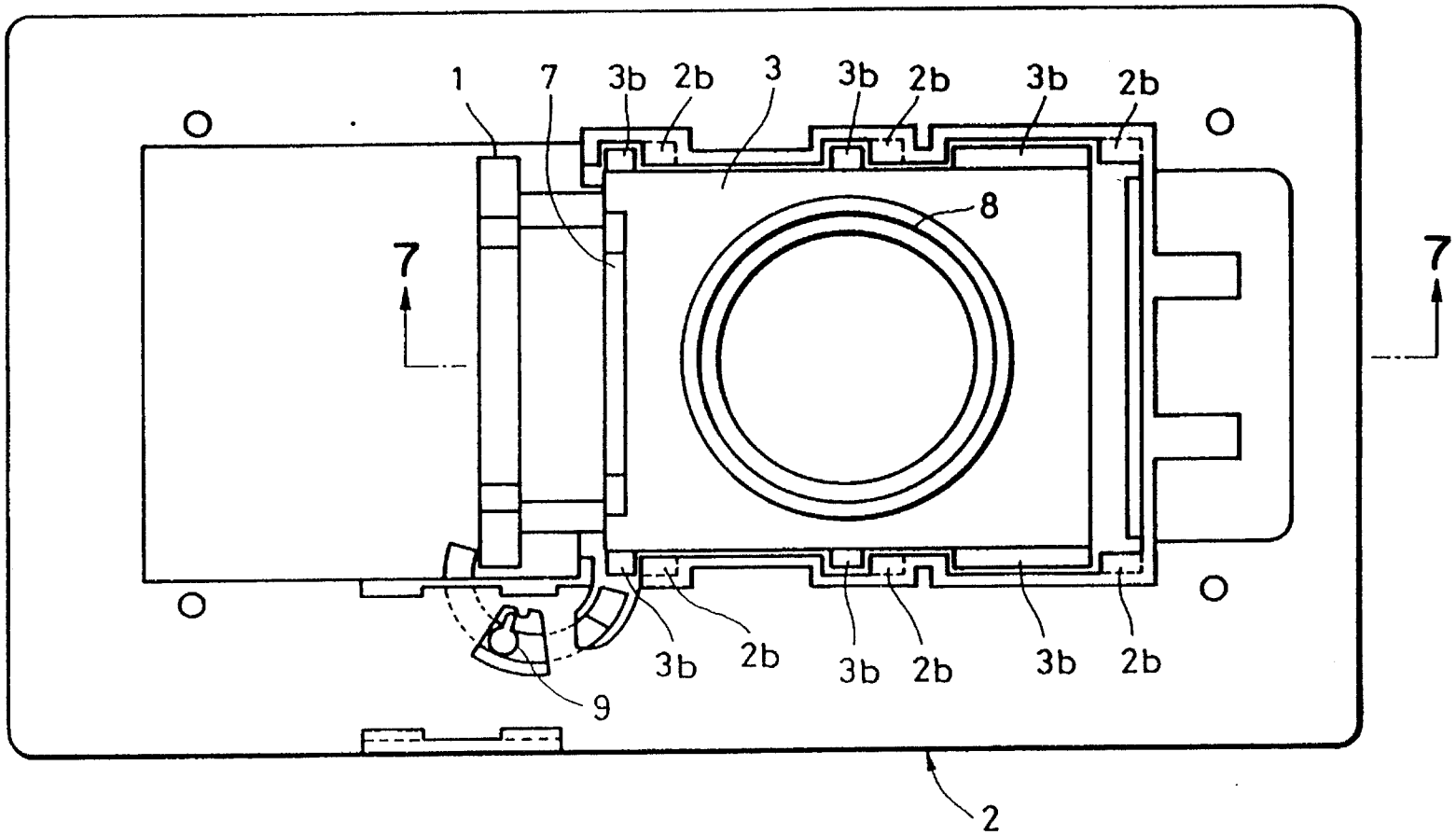
FIG. 6 is a plan view illustrating a state in which the developer cartridge of FIG. 1 is loaded into the developer receiving unit.
Figure 7:
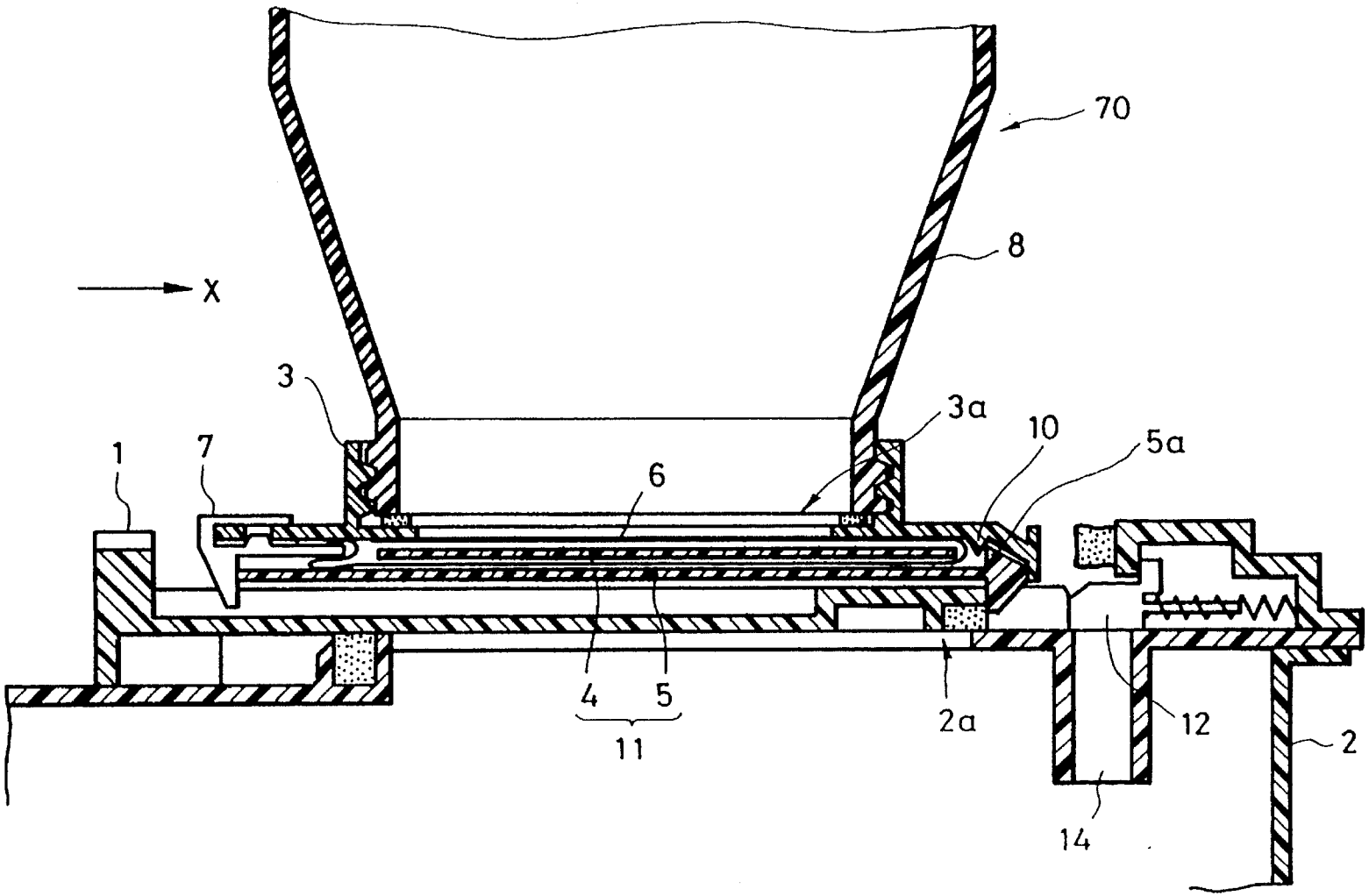
FIG. 7 is an enlarged view illustrating a partial cross section taken along a line 7—7 of FIG. 6.

First, the frame 3 of the developer cartridge 70 is fitted to the guide portion 2*b* of the developer receiving container 2, as shown in FIGS. 6 and 7. Next, the developer cartridge 70 is moved to where the cartridge is supplied by the above-described operation, as shown in FIG. 1 and 2. Then, the locking member 9 is rotated to stop the horizontal movement of the developer cartridge 70 relative to the developer receiving container 2. The rotation of the locking member 9 releases the engagement of the locking member 9 with the sliding type shutter 1, causing the sliding type shutter 1 to move to where the opening 2*a* is opened.

Figure 8:
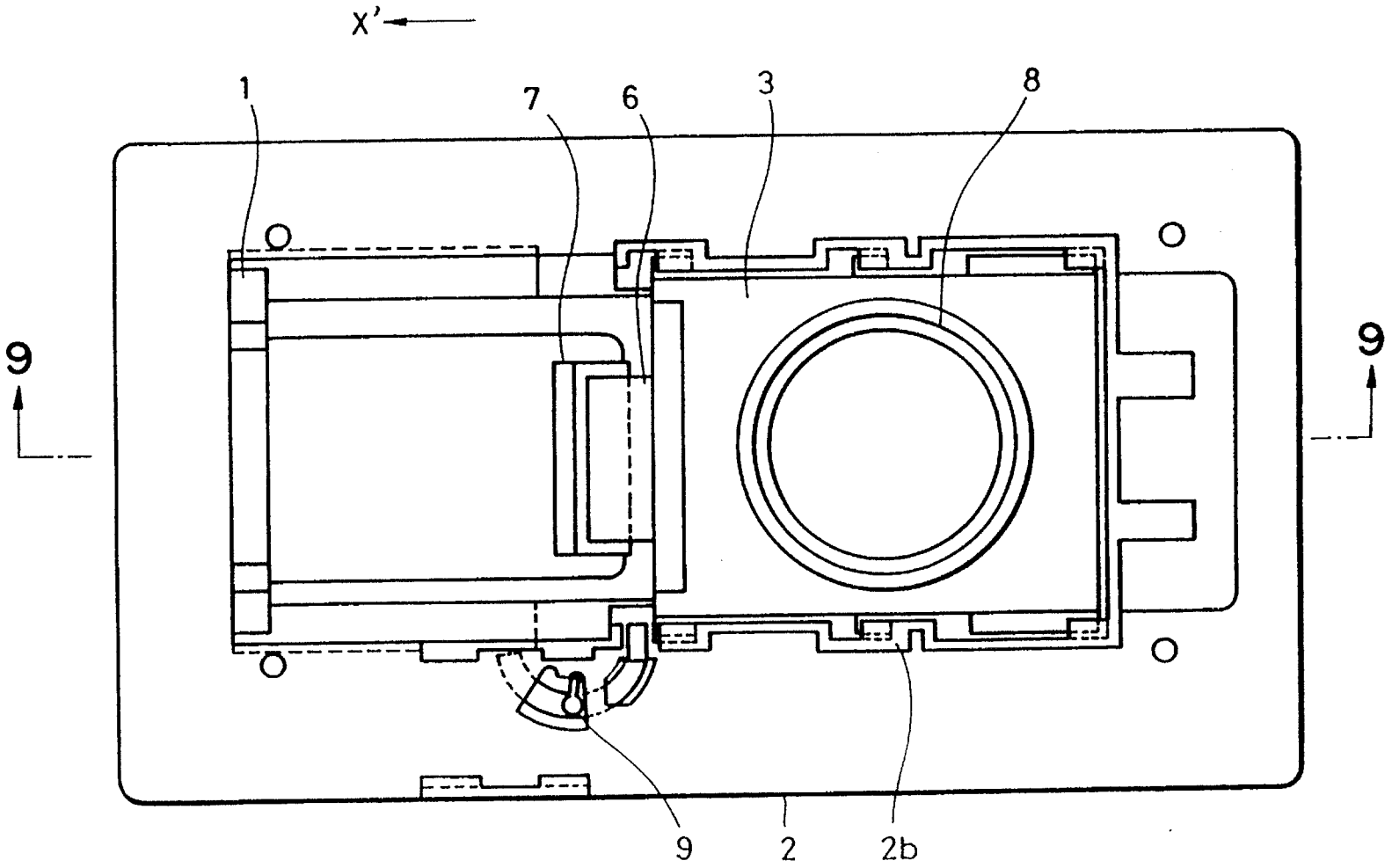
FIG. 8 is a plan view illustrating a state in which the operation for supplying a developer from the developer cartridge of FIG. 1 to the developer receiving unit is prepared.
Figure 9:
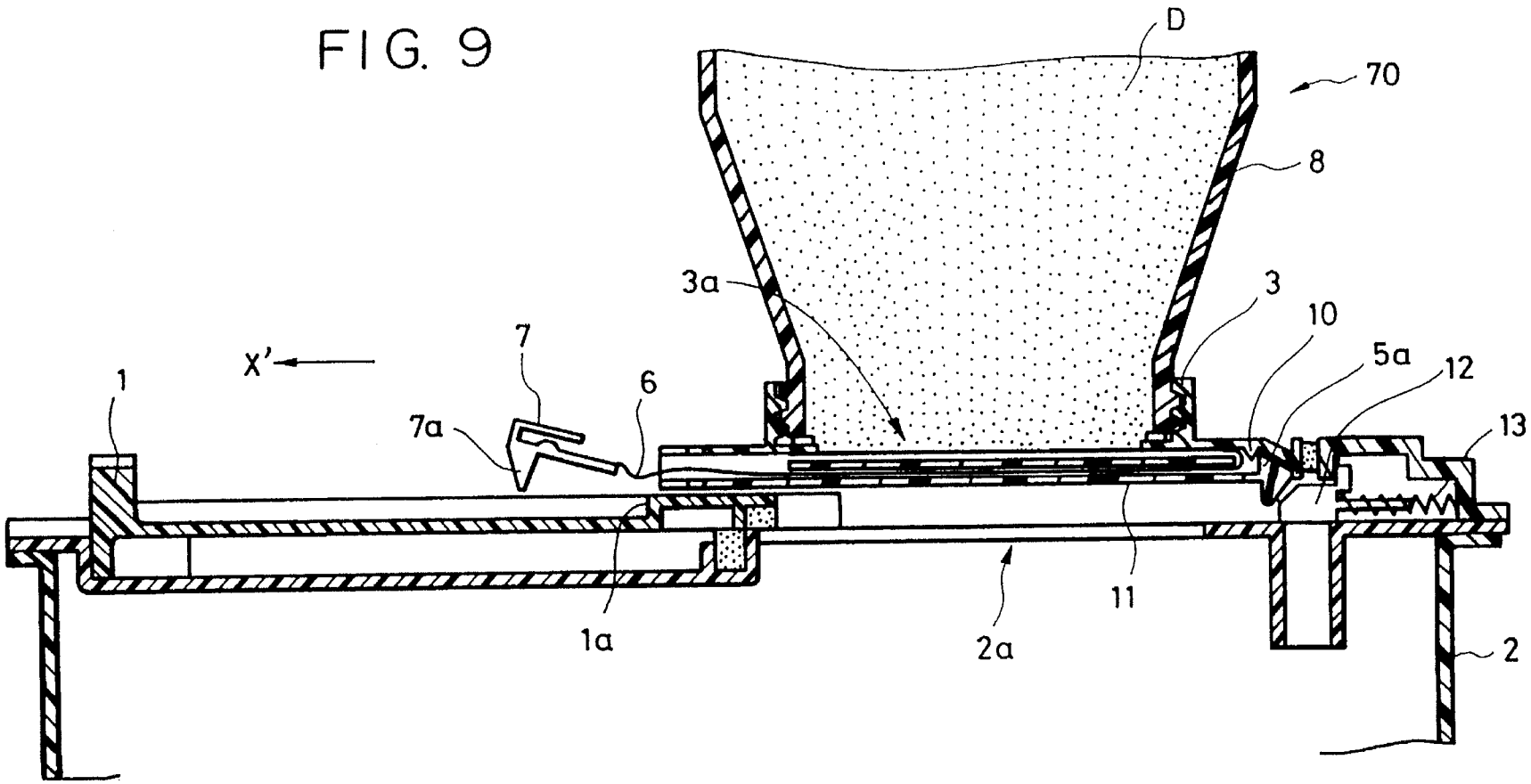
FIG. 9 is an enlarged view illustrating a partial cross section taken along a line 9—9 of FIG. 8.

Next, the sliding type shutter 1 is pulled out manually by the operator to where the opening 2*a* is completely opened, as shown in FIGS. 8 and 9. Since an abutment portion la of the sliding type shutter 1 is brought into abutment with a projection portion 7*a* of the grip 7 during the movement of the sliding type shutter 1, the grip 7 is pressed in the direction in which the sliding type shutter 1 is moved. Consequently, the grip 7 can be released from the frame 3.

Figure 10:
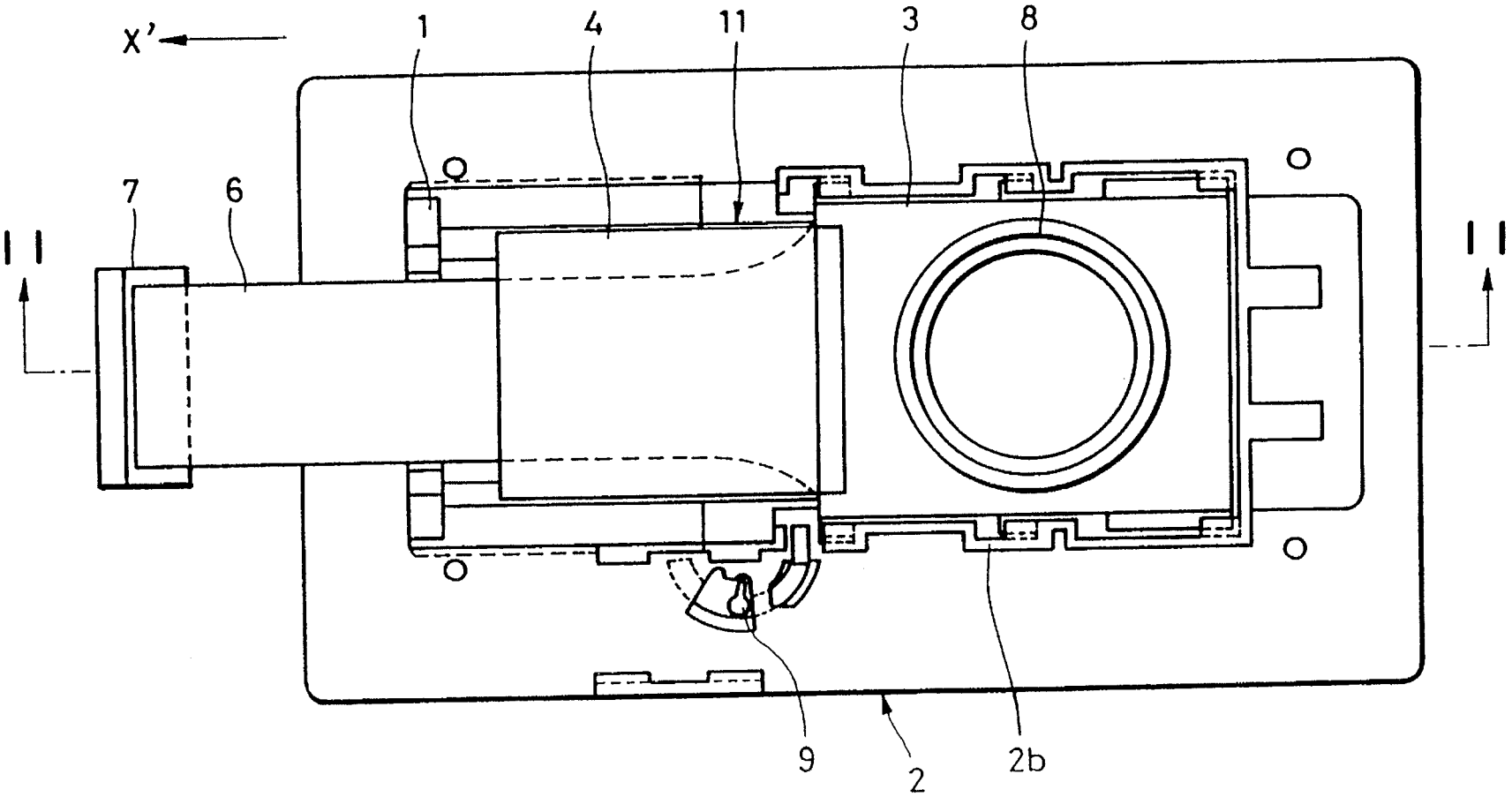
FIG. 10 is a plan view illustrating a state in which the supply of the developer from the developer cartridge of FIG. 1 to the developer receiving unit has been started.
Figure 11:
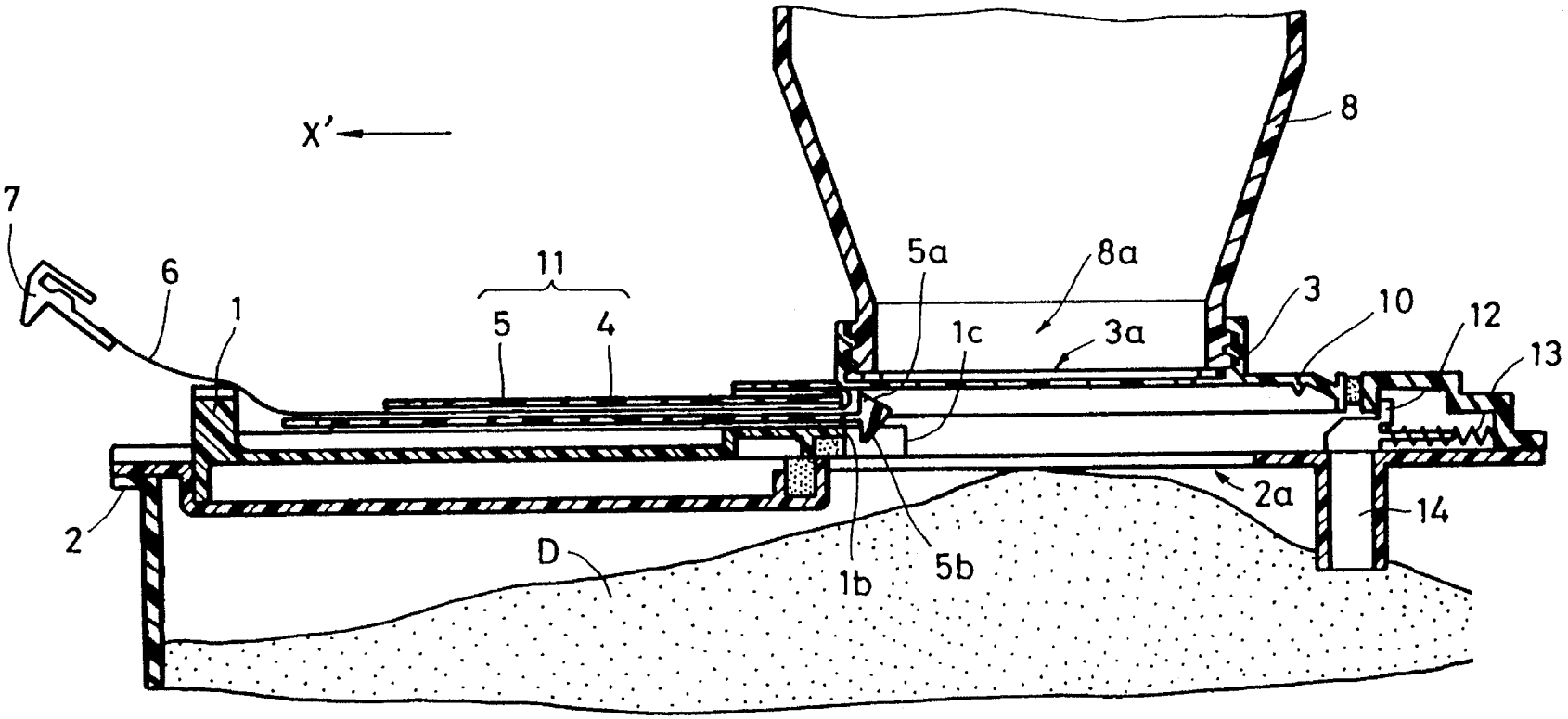
FIG. 11 is an enlarged view illustrating a partial cross section taken along a line 11—11 of FIG. 10.

Next, as shown in FIGS. 10 and 11, the grip 7 is pulled in the direction indicated by arrow X' and the film member 6 is pulled out while the bonding to the periphery of the hole 3*a* is being separated. As the film member 6 is pulled out, the sliding type opening/closing lid 11 is moved in the direction indicated by arrow X', causing the hole 3*a* of the frame 3 to be gradually opened. If the film member 6 is further pulled out a predetermined length, the sliding type opening/closing lid 11 reaches a position where it is opened, and the hole 3*a* of the frame 3 is fully opened. The opening of the hole 3*a* of the frame 3 allows the developer D within the developer supply container 8 to be supplied from the outlet 8*a* through the hole 3*a* and the opening 2*a* of the developer receiving container 2 to the developer receiving container 2.

In this operation some developer may be deposited on the portion of the film member 6 which previously had sealed the hole 3*a* of the frame 3. However, that portion of the film member 6 is housed in the opening between the plate-like members 4 and 5 in a state in which the film member 6 is pulled out a predetermined length. Thus, the developer deposited on that portion is not spilled outside, and the developer disposed on that portion of the film member 6 does not soil the hands and the clothes of the operator or surrounding objects.

When the sliding type shutter 1 is held at an open position, the developer cartridge 70 cannot be unloaded from the developer receiving container 2 by the action of the locking member 9, and thus the developer cartridge 70 is not inadvertently unloaded from the container 2 during the supplying of the developer.

When all of the developer has been supplied, as shown in FIGS. 12 and 13, the sliding type shutter 1 is moved in the direction indicated by arrow X by the manual operation of the operator, causing an edge portion 1*b* of the sliding type shutter 1 to be brought into abutment with the projection 5*b* of the opening/closing lid 11. In this state, the opening/closing lid 11 is pressed by the sliding type shutter 1 as the shutter 1 is moved, and thus is moved in the direction indicated by arrow X. That is, the sliding type opening/closing lid 11 is moved toward the position where the hole 3*a* is closed. The film member 6 is pulled into the frame 3 as the sliding type opening/closing lid 11 is moved. The top end 1*c* of the sliding type shutter 1 begins to press the subshutter 12 in opposition to the elastic force of a spring 13 just before the sliding type shutter 1 reaches a position where the opening 2*a* is closed.

When the sliding type shutter 1 is further moved, the projection 5*a* of the opening/closing lid 11 climbs over the engagement portion 10. Then, the top end of the lid 11 is brought into abutment with the frame 3. As a result, the movement of the lid 11 relative to the frame 3 in the direction indicated by arrow X is stopped. The movement of the shutter 1 in the direction indicated by arrow X is also stopped.

In contrast, the locking member 9 is rotated by an interlocking mechanism (not shown) disposed on the shutter 1 immediately before the movement of the shutter 1 in the direction initiated by arrow X is stopped, thereby releasing the horizontal fixation of the developer receiving container 2 with respect to the frame 3.

The subopening 14 becomes fully open at the same time when the movement of the sliding type shutter 1 is completed. Since the subopening 14 is opened by the subshutter 12 immediately prior to the time the movement of the sliding type shutter 1 is completed, even if developer is supplied in excess to the developer receiving container 2, the excess amount is discharged into the subopening 14. Thus, the sliding type shutter 1 can be closed without the section between the frame 3 and the lid 11 being clogged by the developer.

Next, when the sliding type shutter 1 is released from the hand, the subshutter 12 is pressed and returned in the direction indicated by arrow X' by the spring force of the spring member 13, causing the sliding type shutter 1 to be returned by an amount equal to the distance $L_2$ in the direction indicated by arrow X'. The sliding type shutter 1 is fixed at the position (positions in FIGS. 1 and 2) in which it is pressed and returned by the locking member 9.

Next, as described above, the developer cartridge 70 is moved in the direction indicated by arrow X' and then in the direction indicated by arrow Y', thus being unloaded from the container 2.

Upon the start of the the horizontal movement of the developer cartridge when it is unloaded from the container 2, the projection 5*a* of the lid 11 may climb over the engagement section 10 since a large inertial force acts on the frame 3 or the like, and the sliding type opening/closing lid 11 is moved in the direction indicated by arrow X' relative to the frame 3. When the sliding type opening/closing lid 11 is moved to a position other than a closed position, since the above-mentioned distance $L_1$ is greater than the distance $L_2$, the projection 5*b* of the opening/closing lid 11 is brought into abutment with the engagement section 1*b* of the sliding type shutter 1 before the engagement of the frame 3 with the developer receiving container 2 is released. Therefore, the lid 11 is moved in the direction indicated by arrow X relative to the frame 3 since the developer cartridge 70 is moved in the direction indicated by arrow X' to be unloaded from the container 2. Thus, the lid 11 completely closes the hole 3*a* again, and the projection 5*a* is returned to a position in which it is engaged with the projection 10. In this state, the developer cartridge 70 can be unloaded from the container 2.

As described above, the risk that the sliding type opening/closing lid 11 of the developer cartridge 70 might be opened by an impact generated when it is unloaded from the container 2 is eliminated. Thus, leakage or spillage of the developer at the time of unloading the developer cartridge 70 can be prevented. In addition, it is not necessary to increase the force for holding the sliding type opening/closing lid 11, and an increase in the operational force required for opening/closing the sliding type opening/closing lid 11 can be suppressed.

Even though the developer outlet 12 of the cartridge is closed by a flexible film and a sliding lid, the flexible film may be omitted. In such a case, a knob or the like is provided on the sliding lid of the cartridge and the opening/closing of it is directly operated by the operator.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the claims. The following claims are to be accorded a broad interpretation, so as to encompass all possible modifications and equivalent structures and functions.

What is claimed is:

1. A developer cartridge for supplying a developer to a developer receiving unit, the cartridge comprising:

a main body storing a developer to be supplied to the developer receiving unit;

a guiding portion engagable with guiding means of the developer receiving unit so that the cartridge is movable in a first direction from a first position, where the cartridge is loaded into and unloaded from the developer receiving unit, to a second position, where developer in the main body is to be supplied to the developer receiving unit, and is movable in a second direction, opposite the first direction, from the second position to the first position; and a lid member for opening and closing a developer outlet of the main body of the cartridge, wherein said lid member is moved in the second direction to open the outlet when the cartridge is positioned at the second position, and is moved in the first direction to close the outlet when the cartridge is positioned at the second position, said lid member comprising an engagement portion engagable with an engagement portion provided on the developer receiving unit when the cartridge is moved in the second direction from the second position to the first position and when the lid member is not at a predetermined position where it completely closes the outlet, and wherein, when the engagement portion of the lid member is engaged with the engagement portion of the developer receiving unit, movement of the cartridge in the second direction causes the lid member to move in the first direction relative to the main body of the cartridge, thereby moving the lid member to the predetermined position.

2. A developer cartridge according to claim 1, further comprising locking means for locking the lid member in the predetermined position where the outlet is closed.

3. A developer cartridge according to claim 2, wherein the locking means has a first projection provided on the main body of the cartridge and a second projection provided on the lid member which is engagable with the first projection.

4. A developer cartridge according to claim 3, wherein the engagement portion of the developer receiving unit is provided on a movable shutter member of the developer receiving unit, said movable shutter member being movable in the second direction to open a developer inlet of the developer receiving unit and movable in the first direction to close the developer inlet before the cartridge is moved in the second direction from the second position, and wherein the engagement portion of the lid member is engagable with the engagement portion of the developer receiving unit when the movable shutter member closes the developer inlet.

5. A developer cartridge according to claim 2, wherein the engagement portion of the developer receiving unit is provided on a movable shutter member of the developer receiving unit, said movable shutter member being movable in the second direction to open a developer inlet of the developer receiving unit and movable in the first direction to close the developer inlet before the cartridge is moved in the second direction from the second position, and wherein the engagement portion of the lid member is engagable with the engagement portion of the developer receiving unit when the movable shutter member closes the developer inlet.

6. A developer cartridge according to claim 1, wherein the engagement portion of the developer receiving unit is provided on a movable shutter member of the developer receiving unit, said movable shutter member being movable in the second direction to open a developer inlet of the developer receiving unit and movable in the first direction to close the developer inlet before the cartridge is moved in the second direction from the second position, and wherein the engagement portion of the lid member is engagable with the engagement portion of the developer receiving unit when the movable shutter member closes the developer inlet.

* * * * *

UNITED STATES PATENT AND TRADEMARK OFFICE

CERTIFICATE OF CORRECTION

PATENT NO. : 5,475,479

DATED : December 12, 1995

INVENTOR(S) : TAKUYA HATAKEYAMA, ET AL.

It is certified that error appears in the above-indentified patent and that said Letters Patent is hereby corrected as shown below: Title page, At [56] U.S. Patent Documents "Kaiedo et al." should read --Kaieda et al.--

At [56] Foreign Patent Documents

"3102371 4/1991 Japan" should read --3-102371 4/1991 Japan--.

Column 4

Line 3, "tion 10 or projection" should read --tion or projection 10--.

Column 5

Line 7, "When" should read --when--.

Signed and Sealed this

Twelfth Day of March, 1996

Bruce Lehman

*Attest:*

BRUCE LEHMAN

*Attesting Officer*

*Commissioner of Patents and Trademarks*